United States Patent [19]

Schröter

[11] 4,062,031

[45] Dec. 6, 1977

[54] APPARATUS FOR PRODUCING A DEVELOPER MEDIUM FOR DIAZOTYPE MATERIALS

[75] Inventor: Herbert Schröter, Taunusstein, Germany

[73] Assignee: Hoechst Aktiengesellschaft, Germany

[21] Appl. No.: 661,575

[22] Filed: Feb. 26, 1976

Related U.S. Application Data

[63] Continuation of Ser. No. 395,153, Sept. 7, 1973, abandoned.

[30] Foreign Application Priority Data

Sept. 9, 1972 Germany ..... 2244422

[51] Int. Cl.[2] ..... G03D 7/00; G03D 13/00

[52] U.S. Cl. ..... 354/299; 34/36; 34/155; 219/271; 219/275; 354/300

[58] Field of Search ..... 354/297, 299, 300, 324; 34/36, 145, 155; 219/271, 272, 273, 275

[56] References Cited

U.S. PATENT DOCUMENTS

| | | | |
|---|---|---|---|
| 2,047,104 | 7/1936 | Morse | 354/300 X |
| 2,096,015 | 10/1937 | Von Meister et al. | 354/300 X |
| 3,147,687 | 9/1964 | Halden | 354/300 X |
| 3,524,397 | 8/1970 | Hruby | 354/300 X |

FOREIGN PATENT DOCUMENTS

| | | | |
|---|---|---|---|
| 1,152,659 | 9/1957 | France | 354/300 |
| 1,012,823 | 7/1957 | Germany | 354/300 |
| 541,546 | 4/1956 | Italy | 354/300 |

*Primary Examiner*—Fred L. Braun
*Attorney, Agent, or Firm*—James E. Bryan

[57] ABSTRACT

In an apparatus for producing from a developer solution a gaseous developer medium for diazotype materials, which apparatus includes an inclined surface for passing the developer solution through a vaporizing region from a first end to a second end thereof, heater elements disposed along the vaporizing region, the temperature in the region of the second end being at least 25° C higher than the temperature in the region of the first end and the temperature increasing with the distance from the first end, and a sipon at the second end for collecting the condensate of the vaporized solution. The siphon has a heater element for heating the solution collected therein to the temperature prevailing in the region of the second end to release more gaseous developer medium before the solution leaves the vaporizing region.

3 Claims, 2 Drawing Figures

APPARATUS FOR PRODUCING A DEVELOPER MEDIUM FOR DIAZOTYPE MATERIALS

Figure 1:
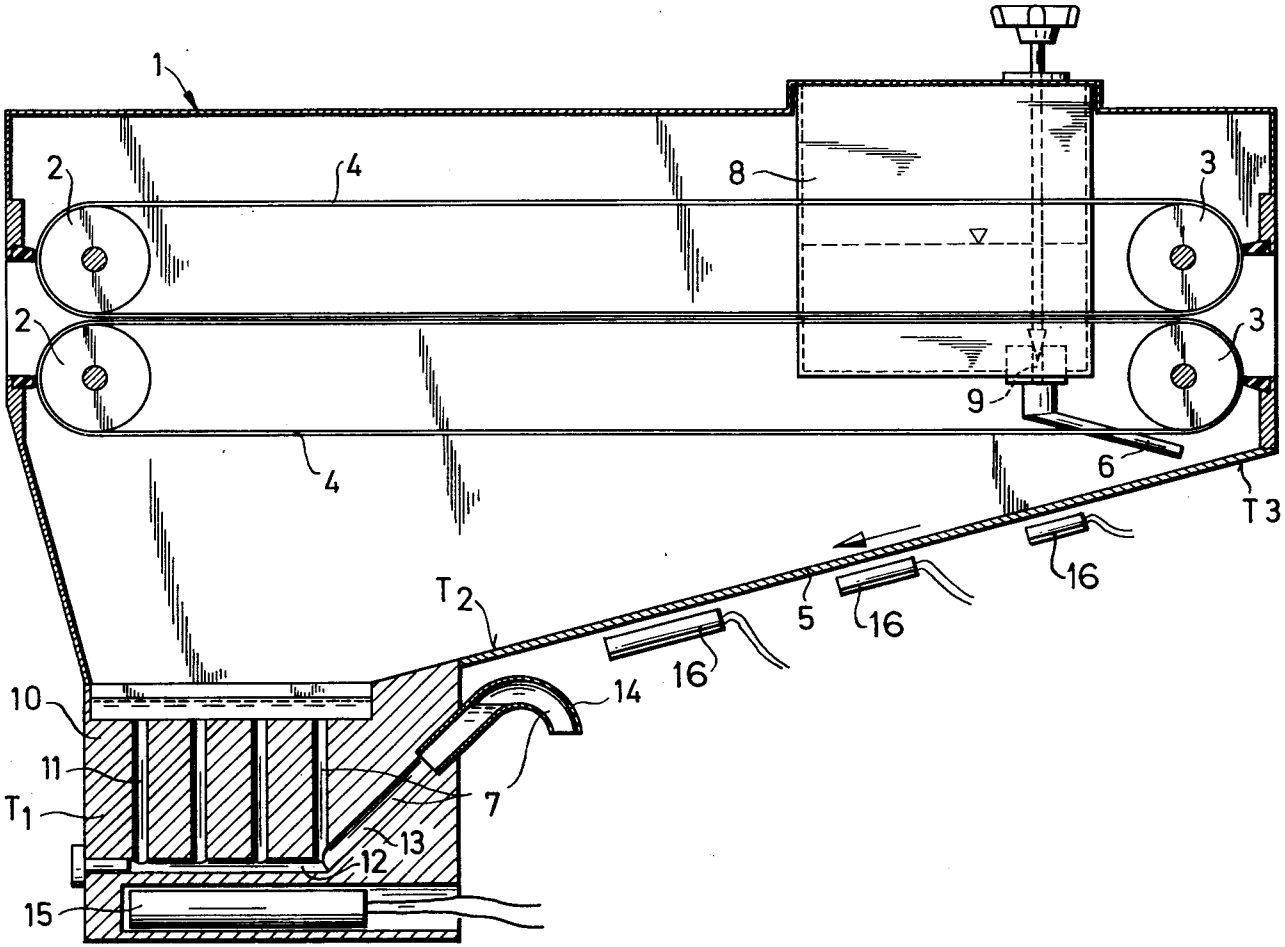

This is a continuation, of application Serial No. 395,153, filed Sept. 7, 1973, and now abandoned.

The invention relates to a process and apparatus for vaporizing from a developer solution a developer medium for use in developing apparatus for diazotype materials. More particularly, the invention relates to a process and apparatus for the production of an ammonia/water vapor mixture from an aqueous ammonia solution, although other developer solutions can also be used according to the invention.

In previously proposed processes and apparatus for developing diazotype materials, an ammonia/water vapor mixture is either produced by heating a dish containing aqueous ammonia, or aqueous ammonia is fed dropwise to a vaporizer. The drops fed to the vaporizer rapidly reach the temperature prevailing in the vaporizer, so that the ammonia is liberated correspondingly rapidly, the amount of ammonia liberated depending on the temperature in the vaporizer and on the initial concentration of the aqueous ammonia solution. Furthermore, ammonia is liberated discontinuously, namely whenever a drop is fed in. As a result of the rapid liberation of the gaseous ammonia, the ammonia produced per unit time is substantially greater than the amount needed to develop the exposed materials, and the excess ammonia must be drawn off to prevent it from penetrating to the exterior through the inlet and outlet orifices for the material.

In the above-mentioned processes water vapor is generated together wth the ammonia and its presence is desirable as it accelerates the developing. The water vapor, however, re-condenses on the parts of the developing apparatus which are at a temperature below that of the vaporizer and ammonia redissolves in the condensed water. This condensate is discharged from the developing apparatus together with the aqueous ammonia solution which has passed through the vaporizer. In the case of a developer solution that initially has a strength of 25%, the condensate has a strength of approximately 10%. Hence, a considerable amount of ammonia is lost to the development process. Furthermore, the condensate is too concentrated to be discharged into the sewerage.

In the process described in German Patent Specification No. 860,138, the vaporizer used is a vaporization channel extending over the width of the apparatus, and provided at one end with an inlet and at the other end with an outlet for the developer solution. The channel can be arranged so that it slops downwards from the inlet to the outlet. Below the channel there are heating elements which heat the channel uniformly over its length. In this vaporizer, again, the aqueous ammonia is very rapidly brought to the temperature prevailing in the vaporizer channel so that the amounts of ammonia liberated per unit time are too great. Furthermore, there is a danger that water vapor will condense on parts of the apparatus which are at a lower temperature than the vaporization channel and that the condensate will collect as a sump product at the bottom of the device. In German Pat. Specification No. 888,364, several vaporization channels are provided in the interior of the developing apparatus, the width and depth of the channels increaing from one end to the other, and heating pipes extend over the entire length. Here again, the disadvantages mentioned above arise.

The present invention provides a process for producing from a developer solution a gaseous developer medium for diazotype materials, which process comprises passing the developer solution through a vaporizing region from a first end to a second end thereof, the temperature in the region of the second end being at least 25° C higher than the temperature in the region of the first end and the temperature increasing with the distance from the first end, the solution being heated to the temperature prevailing in the region of the second end before it leaves the vaporizing region.

In the process of the invention, the rate of flow of the liquid in the vaporizing region is preferably sufficiently slow for the liquid to reach the temperature of each part thereof before leaving that part. Any condensate of the gaseous medium is advantageously returned to the vaporizing region.

The invention also provides apparatus for producing from a developer solution a gaseous developer for diazotype materials, the apparatus comprising a vaporizing region having an inlet and an outlet for the developer solution, means being provided for controlling the temperature of the vaporizing region such that the temperature in the region of the outlet can be maintained at a temperature at least 25° C higher than the temperature in the region of the inlet with the temperature of the vaporizing region increasing with the distance from the inlet.

The outlet in the apparatus of the invention is preferably a siphon, the siphon advantageously being provided with heating means capable of maintaining the siphon region at a temperature at least 25° C higher than the temperature in the region of the inlet. The siphon preferably comprises a block of thermally conductive material having a plurality of downwardly extending bores therethrough, the lower end of each of the bores opening into a common collecting channel.

The apparatus may comprise heating means provided between the inlet and the outlet, the heating capacity of the heating means increasing with the distance from the inlet. Advantageously the vaporizing region includes a vaporizing plate. The vaporizing plate is preferably inclined to the horizontal so that the inlet of the vaporizing region is higher than the outlet. The vaporizer plate may be provided with means for increasing the dwell time of a liquid passing over the plate.

In an alternative form of the apparatus of the invention, the vaporizing region may include a helical passageway. The height of such a helix may, for example, be 30 cm, the windings of the helix having a length of, for example, 300 cm. With these figures, the relationship between the difference in height between the inlet and the outlet and the length of the path travelled by the developer solution is 1 : 10, but vaporizers having different values for this relationship can be used.

Although the process and apparatus of the invention may be used for producing other developers media, they are preferably used for producing a gaseous developing medium comprising an ammonia/water vapor mixture, and the following discussion is directed principally to this preferred use. When the gaseous developing medium is a mixture of water vapor and ammonia the developer solution comprises aqueous ammonia. The use of the process and apparatus of the invention makes it possible for the developer medium to be liberated substantially continuously while the developer solution, including any condensate, leaving the vaporizer, is of a very low strength.

The invention therefore also provides a process for vaporizing from a developer solution a developer medium for a developing apparatus of diazotype materials, in which process the developer solution passes through a temperature gradient of at least 25° C with rising temperature and the developer solution which has passed through the temperature gradient is discharged from the vaporizer, together with any condensate of the vaporized developer medium, after reaching the maximum temperature of the temperature gradient. The invention further provides a vaporizer device for carrying out this process, which device is located inside or outside of the developing chamber and is provided at one end with an inlet and at the other end with an outlet for the developer solution, a siphon acting as the outlet for the developer solution which has run over the vaporizer plate and for any condensate of the vaporized developer medium, and a heating device being provided on the siphon, which heating device can heat the end of the vaporizer plate provided with the siphon to a temperature which is at least 25° C higher than the temperature at the end provided with the inlet.

The process according to the invention makes it possible to achieve a situation wherein a developer solution which drips into a vaporizer is only gradually brought to the maximum temperature so that the gaseous developer medium is not liberated too rapidly and instead, because of the slower temperature rise, the developer medium is released continuously over a longer period. A developer solution of as low concentration as possible is obtained at the vaporizer outlet because not only can the developer solution which has passed through the temperature gradient be discharged from the vaporizer only after reaching the maximum temperature but also any condensate produced in the colder areas of the device, which because of the lower temperature dissolves a large amount of developer medium, can again be brought to the maximum temperature before leaving the vaporizer so that the developer medium is again liberated.

The vaporizer apparatus or device of the invention can be located inside or outside a developing chamber for diazotype materials. If the vaporizer is located inside the developing chamber, the vaporizer does not have to be a sealed device. In that case, a part of the bottom of the developing chamber can be used as the vaporizer plate over which the developer runs. The vaporized developer medium spreads in the developing chamber and acts on the material to be developed. Such a device will be described in more details below. If the vaporizer is outside the developing chamber, it should be in the form of a sealed unit which, in addition to the inlet and outlet for the developer solution, has a tube or the like as a connection to the developer chamber, through which the vaporized developer medium enters the developing chamber. Furthermore, a second connection to the developing chamber is also necessary, through which the condensate produced in colder parts of the developing chamber can be returned from the developing chamber into the vaporizer.

When the apparatus of the invention includes a siphon, both the developer solution which has passed through the temperature gradient and the condensate produced in colder areas of the developing chamber and of the vaporizer leaves the vaporizer only via the siphon.

At one end of the preferred embodiment of the vaporizer device of the invention there is an inlet by means of which developer solution can be dripped onto the vaporizer plate. The inlet is connected to a tank which contains the developer solution. The amount of developer solution dripping into the vaporizer through the inlet per unit time can be regulated by means of a valve. The outlet used is a siphon which consists, in a known manner, of a descending, ascending and finally again descending tube. In a preferred embodiment the first descending part of the tube of the siphon is replaced by several bores of small diameter in a metal block, which ends in a collecting channel which in turn ends in the ascending part of the tube of the siphon. This concentration ensures that the solution which issues from the outlet (the siphon) actually reaches the temperature to which the siphon is heated.

The temperature gradient in the vaporizer plate between the end at which the inlet is situated and the other end, where the siphon is attached, is advantageously produced by a heating device provided at the siphon. Preferably, a part of the siphon is embedded in the vaporizer plate, which is thickened in the region of the siphon and which also accommodates the heating device which can consist of one or more heating elements. As a result of the heating provided at the siphon, the maximum temperature prevails at the siphon while it decreases in the direction of the inlet since these parts of the vaporizer plate are only warmed by conduction. If the vaporizer plate consists of a material of poor conductivity and the temperature decreases very greatly in the direction of the inlet, additional heating elements can be provided in the vaporizer plate, the heating capacity of each heating element being less than that of the heating device of the siphon and being the smaller, the greater the distance of that heating element from the siphon.

In the preferred embodiment of the invention, the vaporizer plate is inclined to the horizontal so that the siphon is located at the lowest point and the inlet at the uppermost point of the vaporizer plate. In order that the developer solution dripping onto the sloping plate should not run too rapidly into the siphon, recesses or low crossbars, which increase the dwell time of the developer solution, can be provided in the vaporizer plate.

The siphon discharges both the developer solution, which has passed through the temperature gradient of the vaporizer plate and has, because of the rising temperature, constantly released developer medium, and also the entire condensate produced in colder areas of the developing chamber and of the vaporizer, which, because of its lower temperature, contains a large amount of dissolved developer medium. In the siphon, this condensate is again brought to the temperature prevailing there and therefore again releases developer medium before it issues through the siphon. As a result, the developer solution which issues only retains a low concentration of developer medium.

In the developing chamber, fans for distributing the developer medium and heating elements for warming the developing space can be provided in a known manner.

Figure 2:
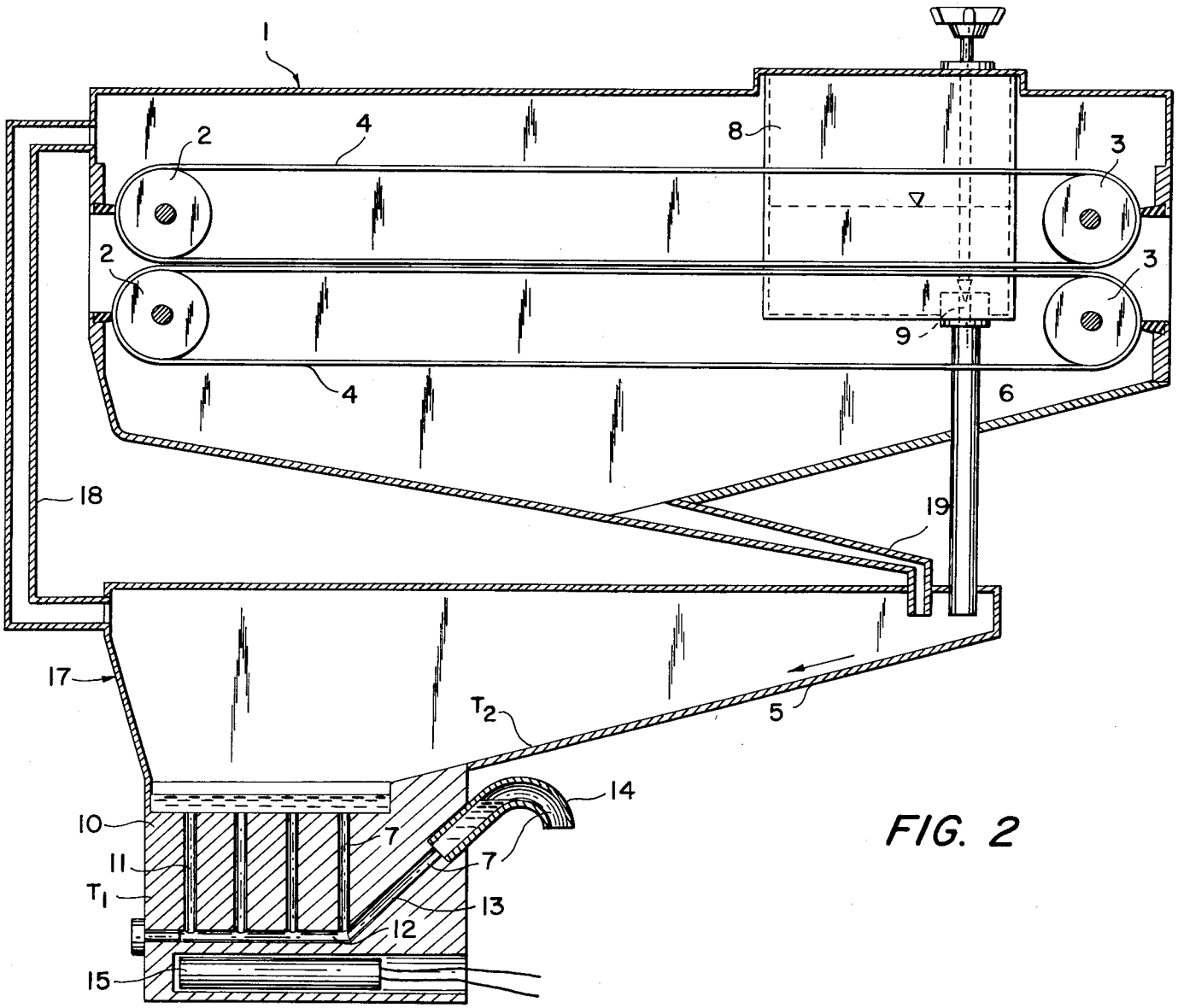

The invention will now be described, by way of example only, with reference to the accompanying drawings, in which FIG. 1 is a longitudinal section through a developing chamber having a vaporizer located therein, and FIG. 2 is a longitudinal section through a developing chamber having a vaporizer located on the exterior thereof.

Referring now to the drawings, a developing chamber 1 is provided with a pair of inlet rollers 2 and a pair of outlet rollers 3 for the material to be developed. An endless conveyor belt 4 runs between each inlet roller 2 and the corresponding outlet roller 3. A part of the bottom of the developing chamber 1 at the same time serves as a vaporizer plate 5. The vaporizer plate 5, however, does not extend over the entire width of the bottom of the developing chamber 1. The vaporizer plate 5 can be separated from the remaining parts of the bottom of the developing chamber 1 by crossbars (not shown). The vaporizer plate 5 is inclined to the horizontal. An inlet 6 for aqueous ammonia is provided at the higher end of the vaporizer plate 5 and a siphon 7 is situated at the lower end of the plate 5. The aqueous ammonia is contained in a supply vessel 8. The amount of aqueous ammonia dripping per unit time through the inlet 6 onto the vaporizer plate 5 can be regulated by a valve 9.

At the end at which the siphon 7 is located, the vaporizer plate 5 broadens out into a metal block 10 in which the siphon 7 is partly embedded. The siphon 7 consists of several vertical bores 11, a collecting channel 12 into which the bores 11 open, an ascending portion 13 which is a continuation of the collecting channel 12 and, finally, a descending portion 14.

The metal block 10 is provided with a heating device 15, this device heating the vaporizer plate 5 and its broadened-out part, the metal block 10. As the heating device 15 is adjacent to the siphon, a temperature gradient becomes established in the vaporizer, with the temperature decreasing from the siphon 7 to the upper part of the vaporizer plate 5. By varying the heating capacity of the heating device 15 and the thermal conductivity of the material of the vaporizer plate 5, different temperature gradients can be set up in the vaporizer plate. The heating capacity of the heating device 15 and the material of the vaporizer plate 5 are preferably so chosen that the following temperatures are set up: a temperature $T_3$ of 40 to 50° C at the upper part of the vaporizer plate 5, where the inlet 6 is located, a temperature $T_2$ of 80° to 90° C at the lower part of the vaporizer plate 5, just before the siphon 7, and a temperature $T_1$ of 90° C up to the boiling point at the siphon 7. A number of heating elements 16 are shown mounted adjacent the vaporizer plate 5, the heating capacity of each heating element being smaller the greater distance of the particular heating element from the siphon.

The aqueous ammonia which drips from the supply vessel 8 via the inlet 6 onto the vaporizer plate 5 runs over the vaporizer plate to the siphon 7. In doing so, each drop passes through the temperature gradient and continuously releases an ammonia/water vapor mixture as the temperature rises. Both the aqueous ammonia which has passed through the temperature gradient and the condensate of the vaporized ammonia/water vapor mixture (which has been produced in the colder parts of the equipment of the developing chamber) collect in the siphon 7. Because its temperature is lower than that of the vaporizer plate 5, this condensate contains a large amount of dissolved ammonia and is of higher strength than the aqueous ammonia which has run over the vaporizer plate 5. Since, however, this condensate can only leave the developing chamber 1 through the siphon 7, it is again warmed in the siphon 7 and releases ammonia in accordance with the temperature $T_1$ prevailing there. In order to ensure that the aqueous ammonia collected in the siphon does actually reach the temperature $T_1$, the first descending part of the tube of the siphon is made in the form of several bores 11, which have a small diameter (for example 1 to 3 mm). As a result the aqueous ammonia is brought to the maximum temperature $T_1$ of the temperature gradient before it leaves the developing chamber 1, and the concentration of the aqueous ammonia issuing through the tube 14 can normally be lowered to 0.3% or less. The siphon 7 prevents, in a known manner, the escape of ammonia gas from the tube 14 to the exterior.

FIG. 2 shows a variation of the embodiment of FIG. 1 of the drawings in which the vaporizer 17 is mounted outside of the developing chamber 1 and is provided with a connecting line 18 for passing the gaseous medium to the developing chamber, and with a connecting line 19 for return of the condensate formed in the developing chamber 1 to the vaporizer.

It will be obvious to those skilled in the art that many modifications may be made within the scope of the present invention without departing from the spirit thereof, and the invention includes all such modifications.

What is claimed is:

1. Apparatus for producing from a developer solution a gaseous developer for diazotype materials, the apparatus comprising means for vaporizing said solution, said means having an upper end and a lower end, inlet and outlet means for said solution, said outlet means comprising a siphon with a descending, ascending and finally again descending portion, said siphon comprising a block of thermally conductive material having a plurality of downwardly extending bores therethrough, the lower end of each of the bores opening into a common collecting channel, and said downwardly extending bores opening into said collecting channel forming at least a part of the first descending portion of said siphon, and electrical heating means for said siphon, said heating means being adapted to heat the siphon to a temperature which is at least 25° C higher than the temperature at the upper end of the means for vaporizing said solution.

2. Apparatus as claimed in claim 1 in which said means for vaporizing said developer solution includes a vaporizer plate inclined to the horizontal and being connected to the siphon.

3. Apparatus as claimed in claim 1 in which said electrical heating means is adapted to maintain the temperature of said siphon in the range of 90° C up to the boiling point of the solution.

* * * * *